US005452501A

United States Patent [19]

Kramer et al.

[11] Patent Number: 5,452,501

[45] Date of Patent: Sep. 26, 1995

[54] HINGE AND CHECK ASSEMBLY

[75] Inventors: Steven T. Kramer, Davisburg; Stephen P. Hall, Dearborn, both of Mich.

[73] Assignee: ITT Corporation, New York, N.Y.

[21] Appl. No.: 128,588

[22] Filed: Sep. 28, 1993

[51] Int. Cl.[6] ..... E05D 11/10

[52] U.S. Cl. ..... 29/11; 16/273; 16/328; 16/385; 16/334; 16/387

[58] Field of Search ..... 16/328, 329, 331, 16/332, 334, 221, 385, 387, 321, 382, 270, 335, 273, 297; 29/11

[56] References Cited

U.S. PATENT DOCUMENTS

| | | | |
|---|---|---|---|
| 1,109,876 | 9/1914 | Soss | 16/385 |
| 1,635,566 | 7/1927 | Victorsohn | 16/329 |
| 2,004,810 | 6/1935 | Hines | 16/385 |
| 2,085,631 | 6/1937 | Burdick | 16/221 |
| 2,405,719 | 8/1946 | Schonitzer | 16/321 |
| 2,569,862 | 10/1951 | Morin | 16/386 |
| 2,812,536 | 11/1957 | Ragsdale | 16/332 |
| 2,985,908 | 5/1961 | Allen et al. | 16/328 |
| 3,370,317 | 2/1968 | Marchione . | |
| 3,438,083 | 4/1969 | Kirk . | |
| 3,710,417 | 1/1973 | Berman et al. . | |
| 3,931,664 | 1/1976 | Nakano et al. . | |
| 3,962,749 | 6/1976 | Abolins | 16/382 |
| 4,309,792 | 1/1982 | Faye | 16/385 |
| 4,532,675 | 8/1985 | Salazar . | |
| 4,615,073 | 10/1986 | Haak | 16/382 |
| 4,800,624 | 1/1989 | Whitefoot et al. . | |
| 5,018,243 | 5/1991 | Anspaugh et al. . | |
| 5,054,165 | 10/1991 | Marchione | 16/270 |
| 5,074,010 | 12/1991 | Gignac et al. . | |
| 5,152,030 | 10/1992 | Cogo . | |

FOREIGN PATENT DOCUMENTS

| | | | |
|---|---|---|---|
| 569683 | 1/1959 | Canada | 16/341 |
| 2742602 | 4/1979 | Germany . | |
| 538122 | 12/1976 | U.S.S.R. | 16/331 |
| 1468656 | 3/1977 | United Kingdom | 16/328 |

*Primary Examiner*—Lowell A. Larson
*Assistant Examiner*—Donald M. Gurley
*Attorney, Agent, or Firm*—Robert P. Seitter; J. Gordon Lewis

[57] ABSTRACT

A hinge and check assembly for checking the door of a motor vehicle when in the open position. The assembly provides a base having check profiles formed therein to establish predetermined check positions. The assembly also provides a strap that provides a spring biased contact surface for engaging the check profiles formed in the base. The strap is pivotally connected to the base through a pivot pin that defines a hinge axis, and the strap is allowed to rotate with the door of the vehicle about the hinge axis. Upon rotation of the strap, the contact surface follows the check profile and establishes a predetermined check position. The check profiles are perpendicular to the pivot pin, and the contact surfaces are perpendicular to the check profiles so that the check force applied to the pivot pin is in an axial direction. By having the check force applied axially to the pivot pin, deformation and wear to the pivot pin and its associated bushing does not occur. The strap and base of the assembly are fabricated from a cast magnesium alloy which provides a light weight, high strength assembly. This reduces weight in the vehicle which in turn leads to improved fuel economy. Also, the casting process reduces the amount of machining operations necessary to form the finished parts, and therefore, tolerances are reduced, and performances are enhanced.

23 Claims, 4 Drawing Sheets

HINGE AND CHECK ASSEMBLY

FIELD OF THE INVENTION

The present invention relates to automobile door hinge and check assemblies and more particularly to a light weight, durable hinge assembly that provides a check means for holding the door of an automobile in an open or partially open position.

BACKGROUND OF THE INVENTION

It is well known in the automotive door hinge art to provide a door check mechanism in combination with a door hinge assembly to control movement of the vehicle door when moving between an open position and a closed position. Such door check mechanisms may be used independently and additionally to the door hinge assemblies, or the door check mechanisms may be integral with the door hinge assembly. It is more efficient to utilize a check mechanism that is integral with the door hinge assembly as the hinge and integral check assembly typically requires less parts and less assembly time than utilizing the check mechanism independently of the hinge assembly.

Several prior art designs have integrated the door check mechanisms into the hinge assembly but such devices are either complex in design or non-durable over the operational life of the assembly. Such complex designs are disclosed in U.S. Pat. No. 3,370,317 to Marchione and U.S. Pat. No. 3,931,664 to Nakano, et al. which both disclose rollers engaging a torsion bar or check spring. These devices typically require a significant amount of lubrication to facilitate the long rolling contact of the rollers with the check spring.

Another common design for integrating the check mechanism with the hinge assembly provides a bent over strike tang on the door portion of the hinge that slides along and compresses a leaf spring member carried on the body portion of the hinge to control movement of the door when moving between the open position and the closed position. Again, this design requires lubrication for easy and quiet operation of the assembly. Also, when the door and assembly is in the open position, the strike tang maintains contact with the leaf spring thus applying a constant stress on the strike tang. Such stress over time reduces durability and reliability as the cyclic stress begins to wear certain components of the hinge and check assembly. For example, the bent over strike tang often comprises a nylon roller that rolls along the leaf spring. These rollers typically wear due to the cyclic life stresses that are applied to the roller by the roller contacting the leaf spring.

Typically, the strike tangs are pivotally connected to a base portion of the hinge by a pivot pin. A bronze bushing is commonly utilized to separate the pivot pin from the assembly, so that the assembly will freely rotate about the pivot pin without wearing the pivot pin. The pivot pin provides for the pivotal movement of the door, and the body portion of the hinge supports the load of the door in the axial direction of the pivot pin. The leaf spring has a contoured planar shape mounted in a plane generally parallel to the pivot pin, and the roller has a rotational axis parallel to the pivot axis. The roller is pivoted rotationally about the pivot pin to perpendicularly engage the leaf spring. When the roller engages the leaf spring a lateral force is applied to the pivot pin and bushing. The lateral force causes the bushing to wear and deform at the point at which the strike tang is connected to the base of the hinge assembly. Such wear and deformation of the bushing leads to performance degradation of the hinge and check assembly and shortens the useful life of the hinge and check assembly.

Such designs are also limited as to whether the assemblies may be utilized on the top or bottom portion of the vehicle door. For example, the roller and leaf spring design typically provides a pair of mounting apertures in the base to connect the base of the hinge assembly to the vehicle body. One of the apertures lies directly under the leaf spring, and therefore, a rigid fastener must be assembled to the base before the leaf spring is connected to the base. This means access must be given through the vehicle body in order to secure the fastener to the vehicle body since the head of the fastener is inaccessible under the leaf spring. Consequently, location of the hinge assembly may be limited as access through the vehicle body may not be possible, such as trying to gain access through an instrument panel of the vehicle in order to utilize the hinge assembly on a front, top hinge of a vehicle door.

Generally, most hinge and integral check assemblies are fabricated from heavy gauge steel to provide strength to the assembly. Such heavy gauge steel adds weight to the vehicle, and therefore reduces fuel economy. Several machining and pressing operations are typically required causing increased tolerances and reduced repeatability leading to degradation of the performance of the assemblies.

SUMMARY OF THE INVENTION

The present invention solves the above problems by providing a light weight, durable hinge and check assembly that increases the operable life of the hinge mechanism while providing for a reduction in weight and number of parts in the hinge and check assembly. This is accomplished by having the check spring apply a load in the axial direction of the pivot pin which is common with the load applied from the weight of the door. Therefore, additional lateral forces are not applied to the bushing, and accelerated deformation and wear of the bushing does not occur. Also, the contact surface may be formed as a hardened steel ball bearing that resists wear. A nylon, acetal, teflon or teflon coated ball bearing support provides for quiet operation of the ball bearing without the need for lubrication. To reduce weight, the part may be fabricated from a cast magnesium alloy. In addition, the casting operation allows for certain features of the parts to be formed into the parts without the need for machining, thereby reducing the number of parts in the hinge and check assembly. To provide flexibility in the application of the hinge and check assembly, all mounting apertures are accessible so that access through the vehicle body is not required to secure the assembly to the vehicle body.

In the preferred form, the hinge and insertable check assembly has a base attached to the body of an automobile and a strap connected to the door of the vehicle. The base has two opposed flanges with a pair of aligned coaxial apertures extending through the flanges to define a hinge axis. The strap has an aperture extending therethrough that is in common alignment with the apertures and the flanges. A pivot pin and bushing extend through the apertures to provide for the rotation of the strap about the hinge axis. The opposed flanges of the base have similar check profiles that are formed into opposing surfaces of the flanges. A pair of steel ball bearings provide contact surfaces that are partially housed within the strap and are biased outwards to engage the opposed surfaces of the flanges. Upon rotation of the strap about the hinge axis, the ball bearings follow the check profiles in the opposed surfaces of the flanges and establish a predetermined angular check position about the hinge axis. The check positions correspond to different angles at which the door of the automobile will stop and remain open.

In another form of the invention, the base and strap of the hinge and insertable check assembly are fabricated from a light weight, high strength material, such as a cast magnesium alloy. It is desirable in the present invention to form the base and strap by casting, since this is more economical and reduces the amount of machining operations required on the parts after casting. In particular, magnesium is a desirable material for casting, since it is more predictable than other casting materials, has less shrinkage, and can be designed with a zero draft. This provides for a reduction in the weight of the automobile, and by casting features of the elements into the base and strap, the total number of parts is reduced to provide a more efficient mechanism. Also, by casting features into the base and strap, closer tolerances are maintained due to less machining operations. The result is less variability between assemblies thereby providing greater repeatability of performance.

In yet another form, the contact surface comprises a cylindrical roller bearing that provides a larger contact surface than the spherical ball bearing. The larger contact surface of the roller bearing distributes the load over a greater surface area in order to eliminate wear in heavy duty applications. The check profiles are changed to accommodate the geometry of the roller bearings upon the strap rotating about the hinge axis.

To this end, it is desirable in the present invention to provide a new and improved hinge and insertable check assembly that provides a longer operable life of the door hinge mechanism by applying the check spring force to the door portion of the hinge in an axial direction; to provide a new and improved hinge and insertable check assembly that reduces the weight of the assembly and reduces the number of parts to provide for ease of assembly.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
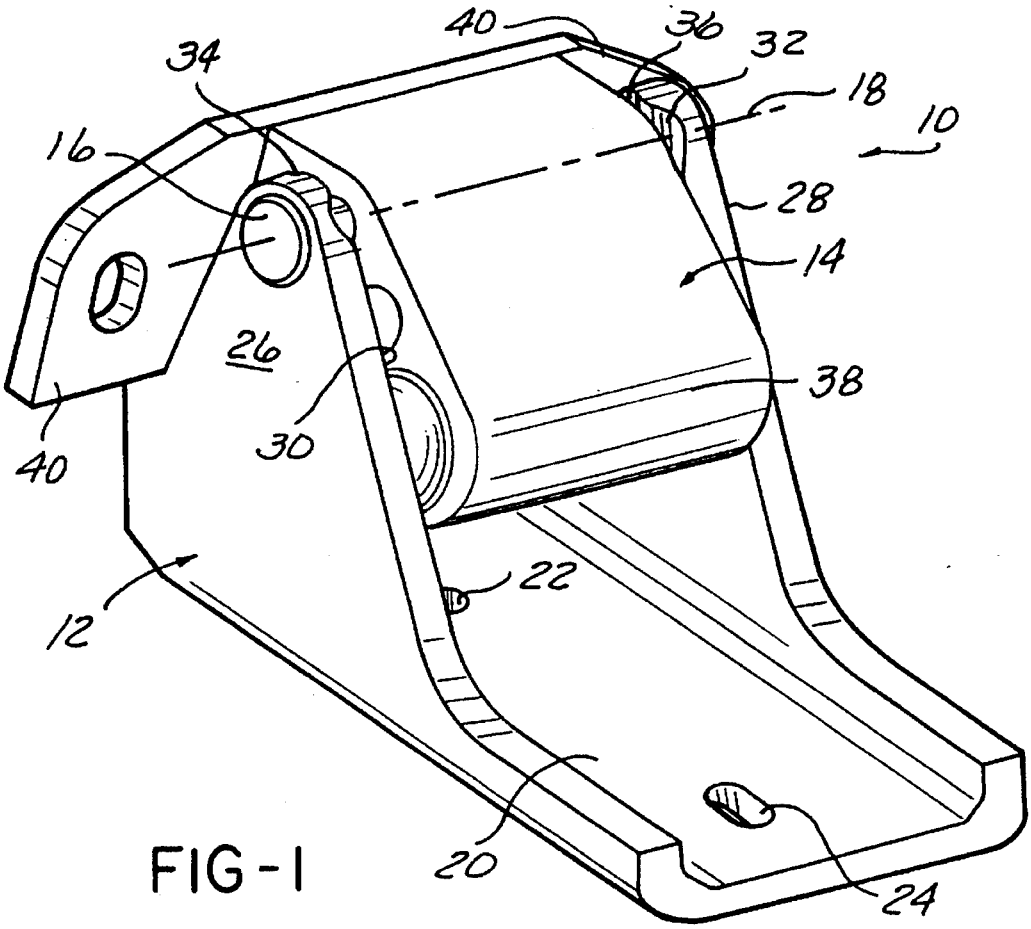
FIG. 1 is a perspective view of the hinge and insertable check assembly in a closed position.

Referring to the drawings, the present invention will now be described in detail with reference to the preferred embodiment.

FIG. 1 shows a hinge and insertable check assembly 10 having a base portion 12 and a strap 14. The strap 14 is pivotally connected to the base 12 by way of a pivot pin 16 which defines a hinge axis 18. The base 12 is connected to a vehicle body (not shown), and the strap 14 is connected to a door (not shown) of the vehicle (not shown). The pivotal connection at the hinge axis 18 allows the strap 14 and the door of the vehicle to rotate between a closed position and an open position about the hinge axis 18. The base 12 provides a check profile means, and the strap 14 provides a follower means, so that upon the vehicle door moving between a closed position and an open position, the door is checked in a predetermined check position by restricting the pivotal movement of the vehicle door upon establishing the predetermined check position.

To maintain flexibility in using the hinge and check assembly 10 in either the top or the bottom of a vehicle door, the base 12 provides a flat mounting portion 20 with a pair of apertures 22, 24 extending therethrough. A pair of conventional fasteners (not shown) are inserted through the apertures 22, 24 for connection to the vehicle body. Clearance is provided between the strap 14 and the flat mounting portion 20 so that access is provided to the fastener. By providing access to the fastener on the base 12 side of the connection with the vehicle body, access is not required through the vehicle body to fasten the base to the vehicle body, and therefore, the assembly may be utilized at the top or the bottom of a front or rear door without having to provide access through the vehicle body.

To apply the check spring force axially along the hinge axis 18, the check profile means are provided perpendicular to the hinge axis 18, and the follower means is perpendicular to the check profile means and parallel to the hinge axis 18. The base 12 provides a pair of outwardly extending flanges 26, 28 integral with and extending from the flat mounting portion 20 of the base 12. The flanges 26, 28 have a pair of coaxially aligned apertures (not shown) extending therethrough for receiving the pivot pin 16 and defining the hinge axis 18. The inwardly opposed surfaces 30, 32 of the flanges 26, 28, respectively, can provide at least one and preferably two check profiles or cam surfaces 34, 36, respectively, formed thereon, as seen in FIGS. 3–7. Depending on the wear characteristics designed for the check profile, the check profile 34, 36 may be formed on a hardened wear-resistant pad (not shown). The profile pad may be connected to the door portion of the hinge 10 such as by a dove tail joint or T-slot joint, or alternative fastening hardware or metal adhesives known to those skilled in the art. In the alternative, a wear-resistant coating may be applied to the cast check profile 34, 36. The wear-resistant coating may be a magnesium-oxide coating such as MAGOXID by Luke Engineering of Wadsworth, Ohio, or a magnesium fluoride/oxofluoride and magnesium oxide composition such as TAGNITE available through Technology Applications Group, Inc. of Grand Forks, N. Dak. Both check profiles 34, 36 are similar in that the opposed surfaces 30, 32 of the flanges 26, 28 mirror one another. The check profiles 34, 36 have sinusoidal configurations with each check profile 34, 36 having at least one and preferably two lobes 37, 39 for establishing predetermined check positions.

Figure 2:
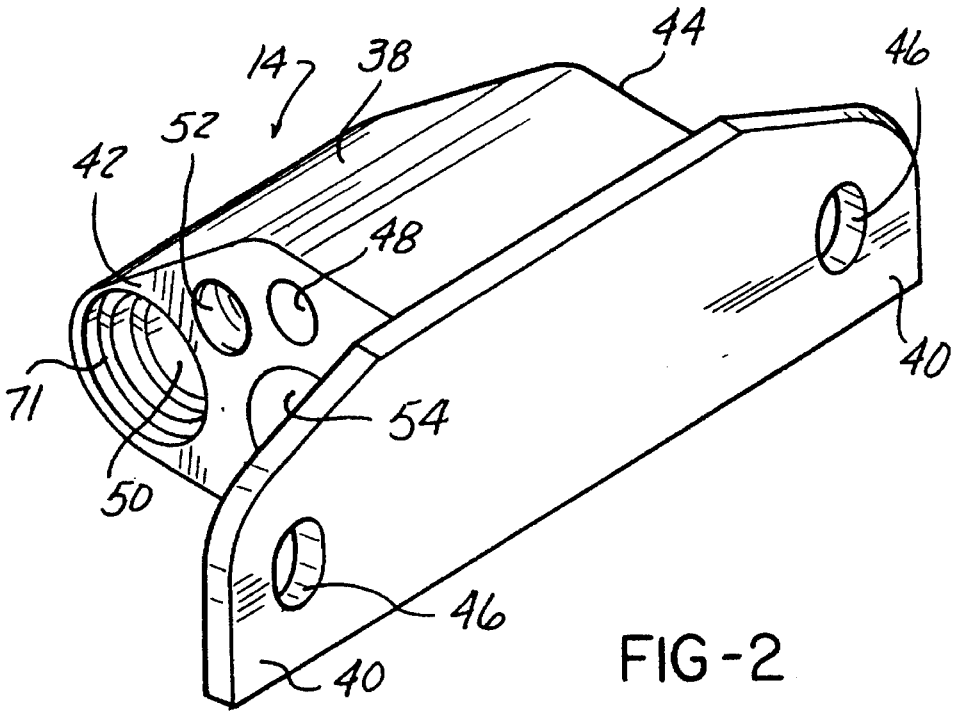
FIG. 2 is a perspective view of the strap of the hinge and insertable check assembly showing the apertures used for housing the contact surface and the pivot pin, as well as apertures utilized to reduce weight.
Figure 3:
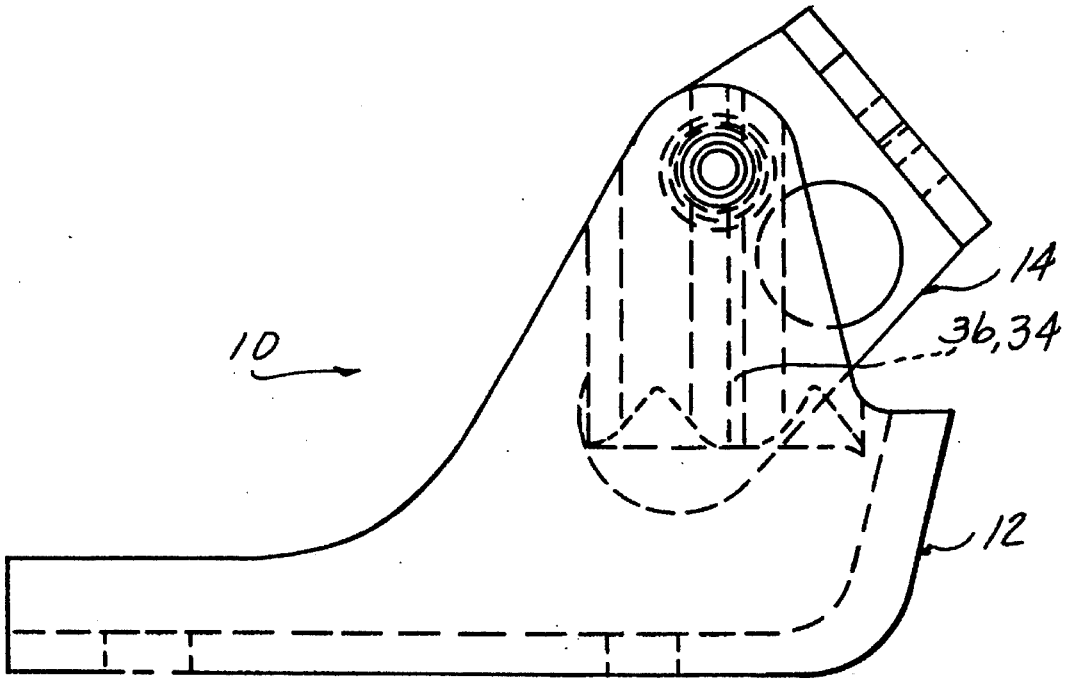
FIG. 3 is a side view of the hinge and insertable check assembly showing the check profiles that are provided when a ball bearing is utilized as a contact surface.
Figure 5:
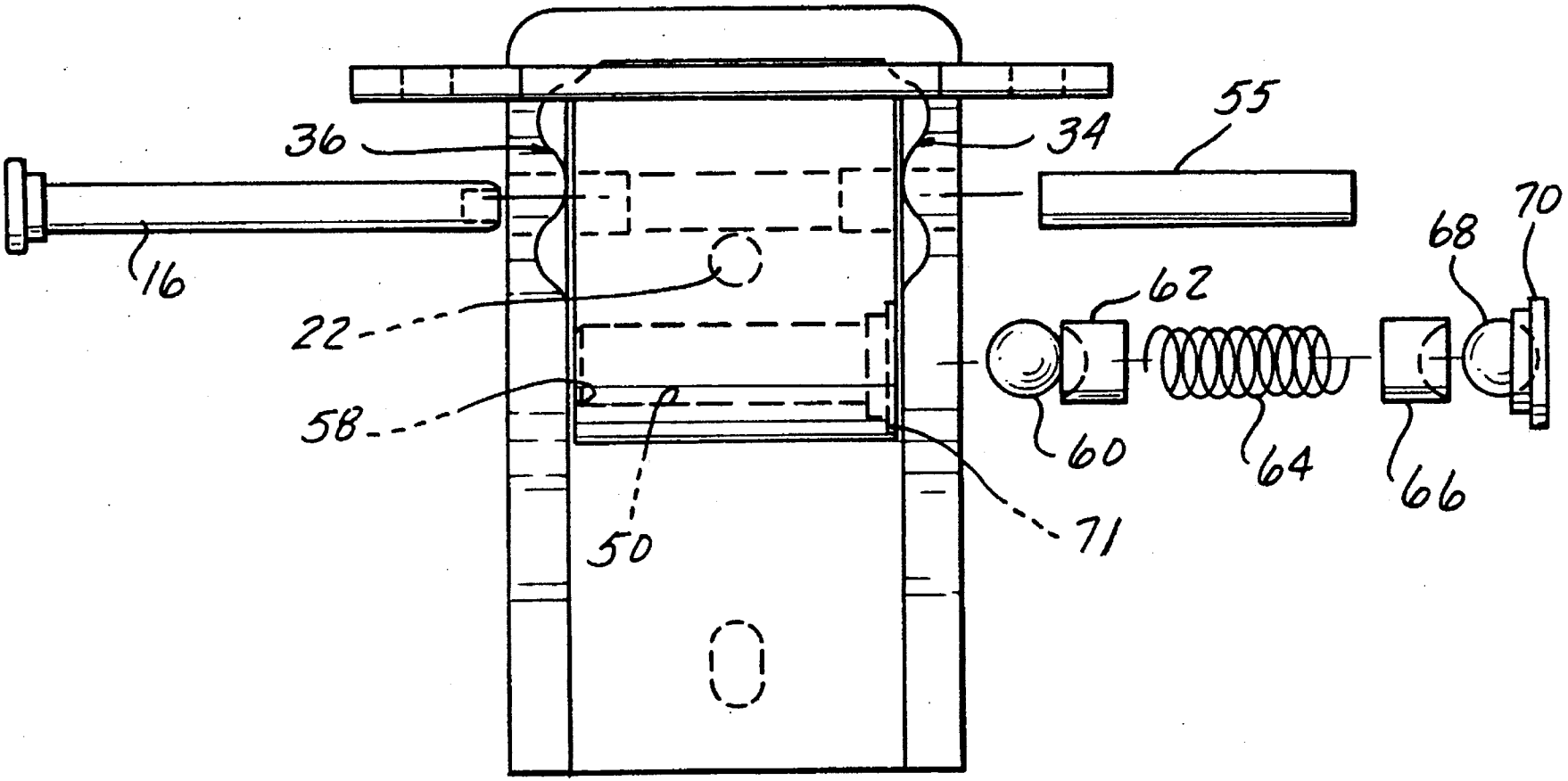
FIG. 5 is a top view with some portions exploded showing the hinge and insertable check assembly.

In order to provide a follower means that operates in a direction perpendicular to the check profiles 34, 36 and parallel to the hinge axis 18, the strap 14 provides a body portion 38 and a pair of mounting ears 40 integral with and extending from opposite sides 42, 44 of the body portion 38 of the strap 14, as seen in FIGS. 1 and 2. An aperture 46 is provided through each of the pair of mounting ears 40, and a conventional fastener (not shown) is inserted through each aperture 46 and secured to the vehicle door. The body 38 of the strap 14 has similar apertures 48, 50, 52, 54 extending therethrough between the opposites sides 42, 44 of the body 38 of the strap 14. The pivot pin aperture 48 is provided for receiving the pivot pin 16 therethrough and for defining the hinge axis 18. A bushing 55, as seen in FIG. 5, lines the pivot aperture 48 to reduce friction and eliminate wear caused by the strap 14 rotating about the hinge axis 18.

The bushing 55 can be fabricated from a plastic, nylon, or preferably teflon, since the bushing 55 does not experience a cyclical increased transverse load, as will be discussed in detail later. The bushing materials provide a reduction in cost and weight compared to a conventional bronze bushing.

The contact surface aperture 50 also extends through the body 38 of the strap 14 between its opposite sides 42, 44 to house the follower means. One end of the contact surface aperture 50 provides an inwardly extending flange 58 that is slightly smaller than the contact surface aperture 50, as seen in FIG. 5. A spherical steel ball bearing 60 can be housed within the contact surface aperture 50 and is seated against the flange 58 at the opening of the aperture 50. The flange 58 is small enough in diameter to prevent the ball bearing 60 from escaping the strap 14, but the flange 58 opening must be large enough to allow the ball bearing 60 to extend outward beyond the side 44 of the body 38 of the strap 14 so that the ball bearing 60 engages and follows the check profile 34. A nylon, acetal, teflon or teflon coated ball bearing support 62 can be housed within the contact surface aperture 50 and seated against the ball bearing 60. The material of the roller bearing support 62 provides a smooth surface for the rolling of the ball bearing 60 without the need for lubrication. An axial compression spring 64 can also be housed within the contact surface aperture and seated against the ball bearing support 62. A similar ball bearing support 66 and spherical steel ball bearing 68 are housed within the aperture 50 and seated against the other end of the spring 64. A retaining means such as a ring 70 is pressed into a counter sunk opening 71 provided in the contact surface aperture 50. The pressed ring 70 retains the ball bearing 68 within the strap 14 while allowing a portion of the ball bearing 68 to extend beyond the side 42 of the body 38 of the strap 14 so that the ball bearing 68 engages and follows the check profile 36 provided in the flange 28.

To provide a check spring force to maintain the check positions, the axial spring 64 biases both ball bearings 60, 68 outward toward the opposed surfaces 30, 32 of the flanges 26, 28 so that pivotal movement of the strap 14 is resisted. Adjustments may be made to the amount of resistive force applied by the roller bearing 60, 68 by simply replacing the axial spring 64 with a spring having a different spring constant. Thus, if heavy doors were being used on a vehicle, a stiffer spring 64 could be used to require a greater amount of pivotal force to move the strap 14 from a predetermined check position.

As seen in FIG. 2, other apertures 52, 54 have and may be bored through the body 38 of the strap 14. These apertures 52, 54 may be used to reduce the weight of the hinge assembly 10, thereby reducing the total weight of the motor vehicle to enhance vehicle performance and fuel economy. Such apertures 52, 54 may also be used to provide additional contact surface apertures for applying a greater resistive force to the strap 14 or for distributing the loads over a larger surface area.

Figure 4:
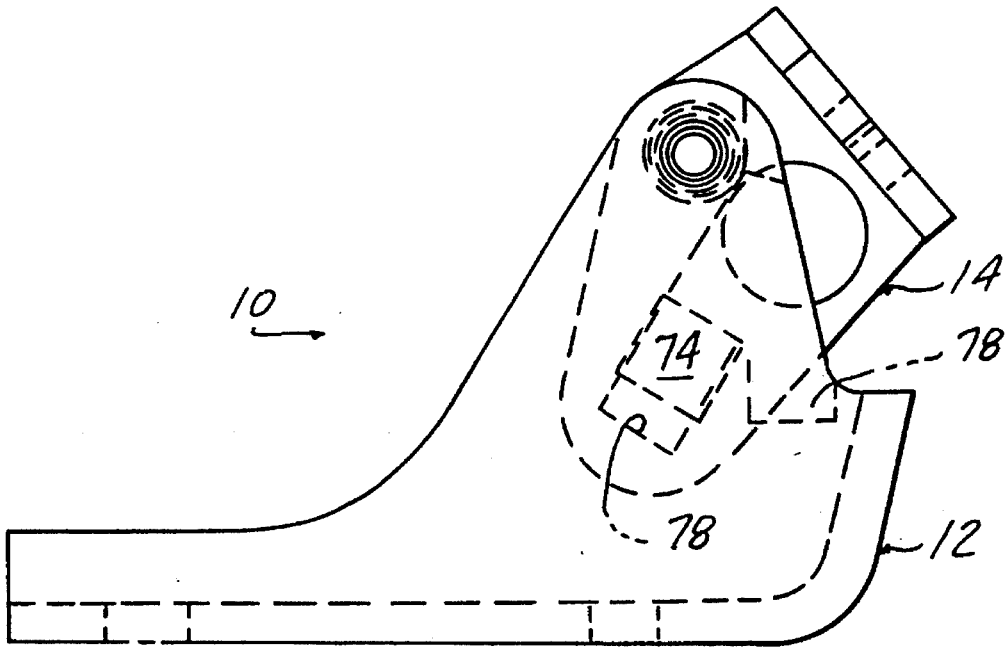
FIG. 4 is a side view of the hinge and insertable check assembly showing the check profiles provided when a cylindrical roller bearing is used as a contact surface.
Figure 7:
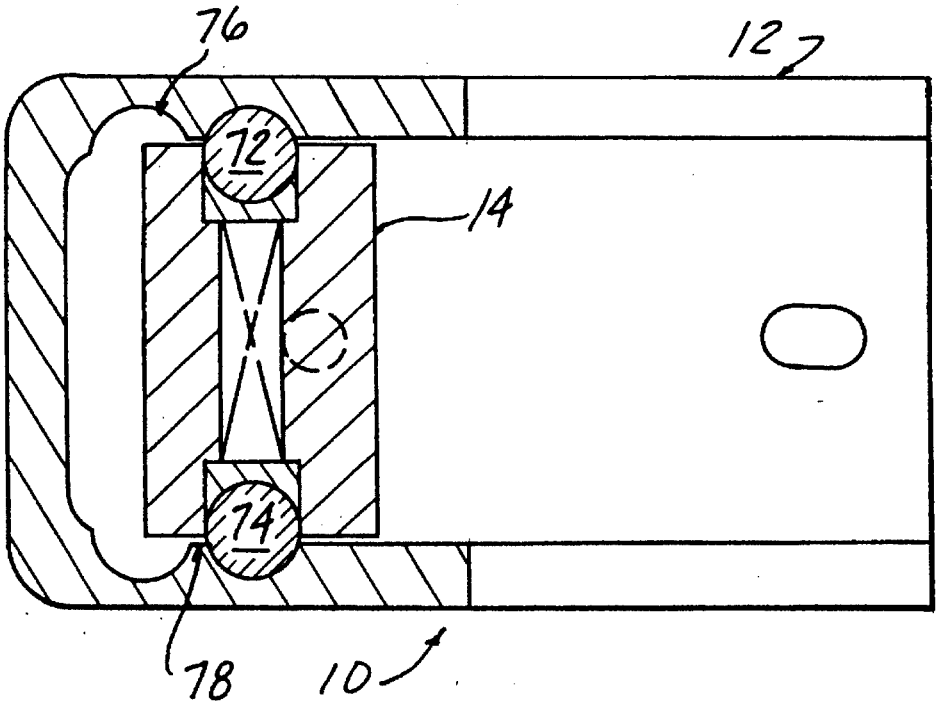
FIG. 7 is a sectional view showing the check profiles that are used when a roller bearing is provided as the contact surface.

In another form, the contact surface provided in the strap 14 is a cylindrical steel roller bearing 72, 74. The roller bearings 72, 74 provide a line for a contact surface instead of a contact point as established by the spherical ball bearings 60, 68. Again, the greater amount of surface area provided by the roller bearing makes the roller bearing 72, 74 less susceptible to wear, since the roller bearing 72, 74 is able to distribute the load over a greater area. The rotational axis of the roller bearing 72, 74 is perpendicular to the hinge axis 18 and lying in a plane normal to the hinge axis 18. Since the roller bearings 72, 74 provide a line of surface contact, the check profiles 34, 36 must be changed to facilitate the pivoting motion of the roller bearings 72, 74, as seen in FIGS. 4 and 7. The check profiles 76, 78 used have a sinusoidal geometry and are angularly spaced on the opposed surfaces 32, 34 of the flanges 26, 28.

In order to provide a light weight, high strength hinge assembly 10, the base 12 and strap 14 may be cast from a magnesium alloy. Die cast magnesium provides an excellent stiffness to weight ratio, and the die casting process allows for most of the structural features of the strap 14 and base 12 to be cast into the parts 12, 14 without the need for machining. The lack of machining allows for greater accuracy in the tolerance of the parts 12, 14, and therefore, the hinge assembly 10 provides excellent repeatability and reliability, thereby leading to an enhancement in performance of the hinge and insertable check assembly 10. In addition, cast magnesium is 100% recyclable which provides for the recycling of such assemblies 10 at the end of their useful lives. Other materials having similar characteristics to a cast magnesium alloy may also be used such as a cast magnesium, cast aluminum, cast zinc-aluminum and alloys thereof.

Figure 6:
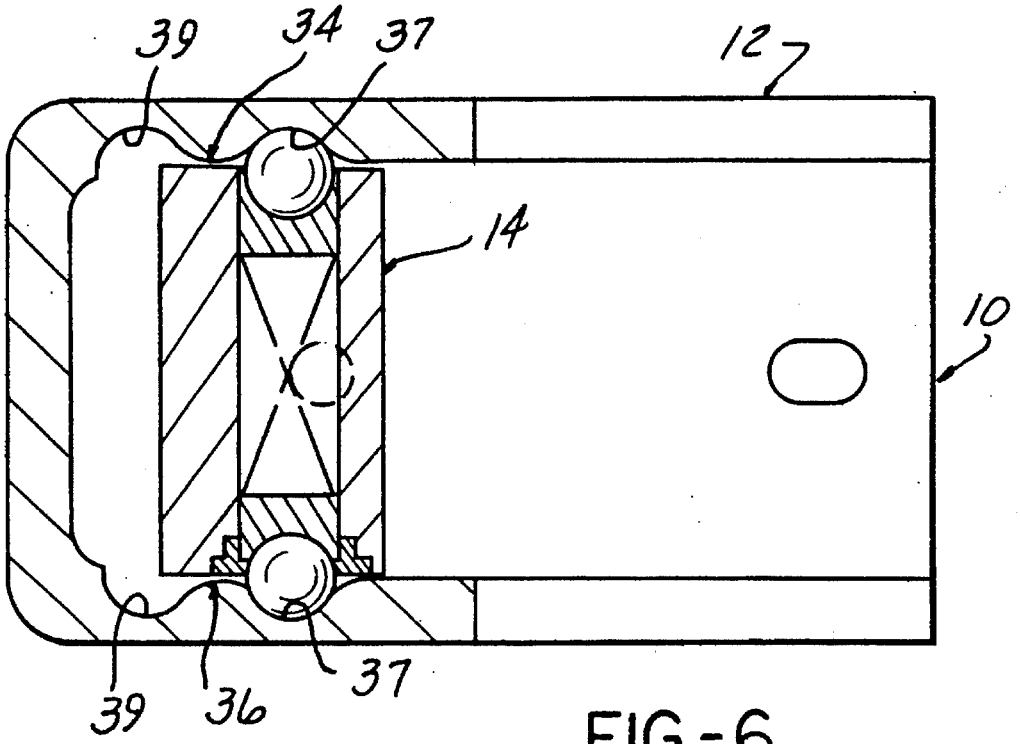
FIG. 6 is a sectional view showing the check profiles that are used when a ball bearing is provided as the contact surface.

To operate the hinge and insertable check assembly 10, the door and strap 14 start in a closed position. The mounting ears 40 of the strap 14 abut the flanges 26, 28 of the base 12, and the two ball bearings 60, 68 engage the opposed surfaces 32, 34 of the flanges 26, 28. At this stage, the opposed surfaces 32, 34 of the flanges 26, 28 are substantially flat so that the strap 14 has little resistance to rotational movement about the hinge axis 18. Upon opening the door of the vehicle and rotating the strap 14 about the hinge axis 18, the pair of ball bearings 60, 68 roll across the flat opposed surfaces of the flanges 26, 28 until the ball bearings 60, 68 reach the first lobe 37 in the check profile 34, 36, as seen in FIG. 6. The first lobe 37 of the check profiles 34, 36 establishes the first check position of the vehicle door as the axial spring 64 urges the ball bearings 60, 68 to be seated in the lobe 37 of the check profile 34, 36. To further rotate the door toward a more open position, a greater amount of pivotal force or check spring force is required to rotate the strap 14 out of the check position than was required for entering the check position. This is caused by the force required to push the ball bearings 60, 68 inward against the spring force in order for the ball bearings 60, 68 to roll out of the lobe 37 defining the first check position. The check spring force is applied perpendicular to the check profile 34, 36, and the pivot pin 16 is loaded axially along the hinge axis 18. This eliminates any additional transverse load applied to the pivot pin 16 and bushing 55, and therefore, the bushing 55 does not wear or deform. As previously mentioned, since no additional load is applied to the bushing 55, the bushing 55 can be fabricated from a light weight, inexpensive plastic which increases fuel economy of the vehicle and reduces overall cost of the hinge assembly 10.

Upon exiting the first check position and rotating the door toward a greater open position, a small substantially flat portion of the opposed surfaces of the flanges 26, 28 is provided and allows rotational movement of the strap 14 about the hinge axis 18 with little restriction. Upon the ball bearings 60, 68 being seated in the second lobe 39 of the check profile 34, 36, the ball bearings 60, 68 are urged by the compressive spring 64 to sit in the lobe 39 thus establishing the second predetermined check position. The mounting ears 40 of the strap 14 abut the flanges 26, 28 when in the second predetermined check position thereby prohibiting the rotation of the door and the strap 14 beyond the second predetermined check position.

It should be noted that this invention is not limited to a pair of similar contact surfaces engaging a pair of similar check profiles, but rather, the present invention may incorporate any number of contact surfaces in combination with any number of check profiles and predetermined check door positions. Also, the contact surfaces may contain different geometries within the same assembly as well as different check profiles within the same assembly. It should also be noted that the invention is not limited to the use of one hinge and insertable check assembly per door, but rather, any number of hinge and insertable check assemblies may be utilized in any location on any one vehicle door depending on the application and its environment. Further, the present invention provides for a simple light weight hinge without a check mechanism by eliminating the assembly of the insertable check mechanism within the strap aperture. Therefore, the present invention can be used in a single door assembly where one hinge includes a check mechanism and the other hinge is without a check mechanism, or in certain heavy duty applications, it may be desirable to provide both hinges with a check mechanism to further reduce wear and to increase durability.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A hinge and check assembly comprising:

a die cast magnesium first member having two opposed surfaces with aligned coaxial apertures formed therein, and said aligned coaxial apertures defining a hinge axis;

at least one cam surface formed in at least one of said two opposed surfaces of said first member; and means, pivotally connected to said first member, for following said at least one cam surface while pivoting about said hinge axis to establish at least one predetermined angular check position about said hinge axis.

2. The hinge and check assembly of claim 1 wherein said following means comprises:

a die cast magnesium second member pivotally connected to said first member at said hinge axis; and at least one contact surface partially housed within said second member and rollingly following said cam surface upon said second member pivoting about said hinge axis.

3. The hinge and check assembly of claim 1 wherein said following means comprises a pair of contact surfaces.

4. The hinge and check assembly of claim 3 wherein said pair of contact surfaces are opposite one another.

5. The hinge and check assembly of claim 3 wherein said pair of contact surfaces comprises a pair of spherical ball bearings.

6. The hinge and check assembly of claim 3 wherein said pair of contact surfaces comprise a pair of cylindrical roller bearings.

7. A hinge and check assembly for pivotally connecting a door member to a fixed frame defining a door opening comprising:

a die cast magnesium base having two opposed surfaces with aligned coaxial apertures formed therein, and said aligned coaxial apertures defining a hinge axis;

at least one check profile formed in at least one of said two opposed surfaces;

an enlarged, integral die cast magnesium strap pivotally connected to said base at said hinge axis and said strap having a plurality of apertures extending longitudinally within said strap and parallel to said hinge axis;

at least one contact surface partially housed within at least one of said plurality of apertures in said strap for rollingly following said at least one check profile while said strap pivots about said hinge axis to establish at least one predetermined angular check position about said hinge axis and said plurality of apertures permitting insertion of additional contact surfaces; and means for biasing said at least one contact surface against said at least one check profile.

8. The hinge and check assembly of claim 7 wherein said contact surface comprises a steel ball bearing.

9. The hinge and check assembly of claim 7 wherein said contact surface comprises a steel cylindrical roller bearing.

10. The hinge and check assembly of claim 7, wherein said biasing means comprises:

a spring housed within one of said plurality of apertures within said strap;

a contact surface support housed within said one of said plurality of apertures and seated on said spring;

said at least one contact surface seated on said contact surface support; and means for retaining said contact surface so that a portion of said contact surface extends outward from said strap for engaging said at least one check profile.

11. A hinge and check assembly for pivotally connecting a motor vehicle door to a body of a motor vehicle and checking said motor vehicle door upon said motor vehicle door pivoting between a closed position and an open position comprising:

a die cast magnesium base connected to said body and having two opposed flanges with aligned coaxial apertures formed therethrough, and said aligned coaxial apertures defining a hinge axis;

an enlarged integral die cast magnesium strap connected to said door and having a plurality of through bores extending longitudinally through said strap and parallel to said hinge axis;

a pair of similar check profiles formed in each of said two opposed flanges for establishing two predetermined angular check positions with respect to said hinge axis;

a pair of similar contact surfaces partially housed within opposite ends of one of said plurality of said through bores in said strap and having one of said pair of similar contact surfaces following one of said pair of similar check profiles in one of said two opposed flanges of said base, and the other of said pair of similar contact surfaces following the other of said pair of said similar check profiles in the other of said two opposed flanges of said base and said plurality of through bores permitting insertion of additional contact surfaces;

means for spring biasing said pair of similar contact surfaces toward said pair of similar check profiles; and a pivot pin for pivotally connecting said strap to said base through said coaligned apertures of said base to provide angular rotation of said strap about said hinge axis to establish a door check position corresponding to one of said two predetermined angular check positions.

12. The hinge and check assembly of claim 11 wherein said spring biasing means comprises:

a spring housed within said one of said plurality of through bores in said strap and said spring having opposite ends;

a pair of contact surface supports housed within said one of said plurality of through bores in said strap and seated on said opposite ends of said spring;

said pair of similar contact surfaces seated on said pair of contact surface supports; and means for retaining said pair of similar contact surfaces so that a portion of said contact surface extends outward from said strap for engaging said opposed flanges of said base.

13. The hinge and check assembly of claim 1 wherein said pair of similar contact surfaces comprise a pair of similar steel ball bearings.

14. The hinge and check assembly of claim 11 wherein said pair of similar contact surfaces comprise a pair of similar steel cylindrical roller bearings.

15. The hinge and check assembly of claim 11, further comprising:

a second pair of similar contact surfaces partially housed within opposite ends of a second one of said plurality of through bores in said strap and having said second pair of similar contact surfaces following one of said pair of similar check profiles in one of said two opposed flanges of said base, and the other of said second pair of similar contact surfaces following the other of said pair of similar check profiles in the other of said two opposed flanges of said base; and second means for spring biasing said second pair of similar contact surfaces toward said pair of similar check profiles.

16. A hinge assembly having at least two hinges for pivotally connecting a motor vehicle door to a body of a motor vehicle wherein each of said hinges comprises:

a die cast magnesium base having two opposed surfaces with aligned, coaxial apertures formed therethrough and defining a hinge axis;

an enlarged, integral die cast magnesium strap having a pivot aperture therein alignable with said coaxial apertures of said base;

a pivot pin insertable through said pivot aperture of said strap and through said aligned, coaxial apertures of said base;

said base having at least one of said two opposed surfaces having at least one check profile formed thereon; and said strap having at least one aperture formed therethrough and spaced radially from said aligned, coaxial apertures.

17. The hinge assembly of claim 16 wherein one of said two hinges further comprising:

at least one cam follower inserted into said aperture of said strap;

means for biasing said at least one cam follower toward said check profile of said base; and wherein said coaxial apertures of said base are aligned with said hinge axis of said base with said at least one cam follower positioned to engage said at least one check profile while said strap pivots about said hinge axis with respect to said base.

18. The hinge assembly of claim 17 wherein said other hinge of said pair of hinges further comprising:

at least one cam follower inserted into said aperture of said strap;

means for biasing said at least one cam follower toward said check profile of said base; and wherein said coaxial apertures of said base are aligned with said hinge axis of said base with said at least one cam follower positioned to engage said at least one check profile while said strap pivots about said hinge axis with respect to said base.

19. The hinge assembly of claim 16, further comprising:

a non-metallic bushing coaxially aligned with said hinge axis within said pivot aperture of said strap.

20. A method of manufacturing a hinge assembly and check comprising the steps of:

die casting a magnesium base having two opposed surfaces with aligned, coaxial apertures formed therethrough and defining a hinge axis, at least one of said two opposed surfaces having at least one check profile formed thereon;

die casting a magnesium strap having a pivot portion therein alignable with said coaxial apertures of said base, and at least one follower-receiving aperture formed therethrough and spaced radially from said aligned, coaxial apertures;

inserting a pivot pin through said coaxial apertures of said strap and said aligned, coaxial apertures of said base.

21. The method of manufacturing a hinge assembly of claim 20 further comprising the steps of:

inserting at least one cam follower into said follow-receiving aperture of said strap;

biasing said at least one cam follower toward said check profile of said base; and aligning said coaxial apertures of said base with said hinge axis of said base with said at least one cam follower positioned to engage said at least one check profile.

22. A hinge and check assembly for pivotally connecting a door member to a fixed frame defining a door opening comprising:

a die cast magnesium base having a unitary construction with two opposed surfaces having aligned coaxial apertures formed therein, and a mounting portion integral with and extending between said two opposed surfaces, and said aligned coaxial apertures defining a hinge axis;

means for connecting said base to said fixed frame wherein said connecting means is readily accessible on said mounting portion when said strap is in an open position;

at least one check profile formed in at least one of said two opposed surfaces;

a die cast magnesium strap pivotally connected to said base at said hinge axis;

at least one contact surface partially housed in said strap for rollingly following said at least one check profile while said strap pivots about said hinge axis to establish at least one predetermined angular check position about said hinge axis; and an axial compression spring housed within said strap and engaging said contact surface for biasing said contact surface against said at least one check profile.

23. The hinge and check assembly of claim 22, further comprising at least one smooth contact surface support disposed within said strap for rollingly supporting said contact surface.

* * * * *

UNITED STATES PATENT AND TRADEMARK OFFICE

CERTIFICATE OF CORRECTION

PATENT NO. : 5,452,501

DATED : September 26, 1995

INVENTOR(S) : Steven T. Kramer and Stephen P. Hall

It is certified that error appears in the above-indentified patent and that said Letters Patent is hereby corrected as shown below:

Column 9, line 41, delete "1" and insert --11--.

Signed and Sealed this

Twenty-third Day of January, 1996

*Attest:*

Bruce Lehman

BRUCE LEHMAN

*Attesting Officer*

*Commissioner of Patents and Trademarks*